US007255668B2

(12) United States Patent
Janzen

(10) Patent No.: US 7,255,668 B2
(45) Date of Patent: Aug. 14, 2007

(54) FOLDING APPLIANCES

(75) Inventor: Igor Janzen, Frankenthal (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 295 days.

(21) Appl. No.: 10/504,844

(22) PCT Filed: Jan. 31, 2003

(86) PCT No.: PCT/DE03/00269

§ 371 (c)(1),
(2), (4) Date: Aug. 26, 2004

(87) PCT Pub. No.: WO03/072477

PCT Pub. Date: Sep. 4, 2003

(65) Prior Publication Data

US 2005/0103215 A1 May 19, 2005

(30) Foreign Application Priority Data

Feb. 26, 2002 (DE) ..... 102 08 292

(51) Int. Cl.
*B31F 1/00* (2006.01)

(52) U.S. Cl. ..... 493/432; 493/442; 493/428

(58) Field of Classification Search ..... 493/434, 493/424, 427, 428, 432, 442, 443, 454; 270/50, 270/42, 38
See application file for complete search history.

(56) References Cited

U.S. PATENT DOCUMENTS

| | | | | |
|---|---|---|---|---|
| 2,919,914 | A * | 1/1960 | Harless | 493/431 |
| 3,517,920 | A * | 6/1970 | Snyder | 493/431 |
| 4,190,242 | A | 2/1980 | Bolza-Schunemann | |
| 4,273,320 | A * | 6/1981 | Fujishiro | 493/427 |
| 4,380,449 | A * | 4/1983 | Michalik | 493/424 |
| 5,065,993 | A * | 11/1991 | Reponty | 270/49 |
| 5,284,466 | A * | 2/1994 | Magnusson et al. | 493/385 |
| 5,359,929 | A | 11/1994 | Hansen | |
| 5,405,126 | A | 4/1995 | Mack | |
| 5,468,209 | A * | 11/1995 | Rohrhiursch et al. | 493/424 |
| 5,551,678 | A * | 9/1996 | Michalik et al. | 270/20.1 |
| 5,653,429 | A * | 8/1997 | Michalik et al. | 270/8 |
| 5,741,209 | A | 4/1998 | Hillebrand et al. | |
| 5,901,647 | A | 5/1999 | Kohlmann | |
| 5,983,753 | A | 11/1999 | Kostiza | |
| 6,004,242 | A | 12/1999 | Kostiza | |
| 6,398,704 | B1 * | 6/2002 | Shibuya et al. | 493/424 |
| 6,550,385 | B1 | 4/2003 | Colin et al. | |

(Continued)

FOREIGN PATENT DOCUMENTS

| | | |
|---|---|---|
| DE | 1 222 082 | 9/1960 |

(Continued)

*Primary Examiner*—Sameh H. Tawfik
(74) *Attorney, Agent, or Firm*—Jones, Tullar & Cooper, P.C.

(57) ABSTRACT

A folding appliance includes a rotatable folding blade cylinder for transporting a signature to be folded, and at least one folding blade that can rotated about a first axle inside the folding blade cylinder. That first axle is held on a carrier which, in turn, can be rotated about a second axle. The folding blade can extend out of the folding blade cylinder during the course of rotation of the folding blade cylinder. The carrier and the folding blade cylinder can be phase-displaced in relation to each other.

26 Claims, 5 Drawing Sheets

U.S. PATENT DOCUMENTS

| | | | | |
|---|---|---|---|---|
| 6,726,616 | B2 * | 4/2004 | Militzer et al. | 493/424 |
| 6,779,788 | B2 * | 8/2004 | Takahashi et al. | 270/20.1 |
| 6,869,388 | B2 * | 3/2005 | Kostiza | 493/424 |
| 6,895,858 | B2 * | 5/2005 | Kostiza et al. | 101/219 |
| 6,923,753 | B2 * | 8/2005 | Jackson et al. | 493/432 |

FOREIGN PATENT DOCUMENTS

| | | |
|---|---|---|
| DE | 41520 | 1/1964 |
| DE | 295 02 957.9 | 2/1995 |
| DE | 196 25 083 | 6/1996 |
| DE | 197 55 428 | 12/1997 |
| DE | 100 32 815 | 7/2000 |
| EP | 0 607 514 | 12/1992 |
| EP | 0 814 959 | 1/1998 |
| EP | 0 922 661 | 12/1998 |
| WO | WO 96/29204 | 9/1999 |

* cited by examiner

Fig. 1
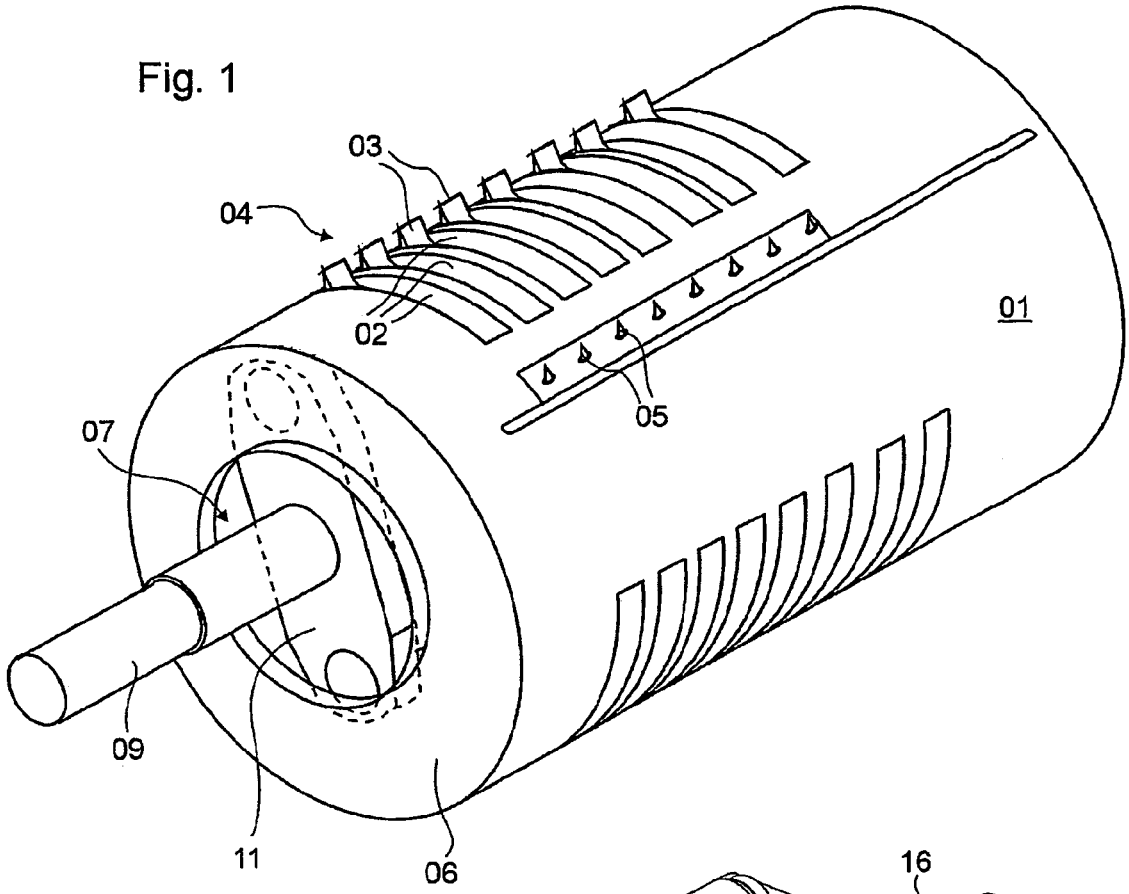
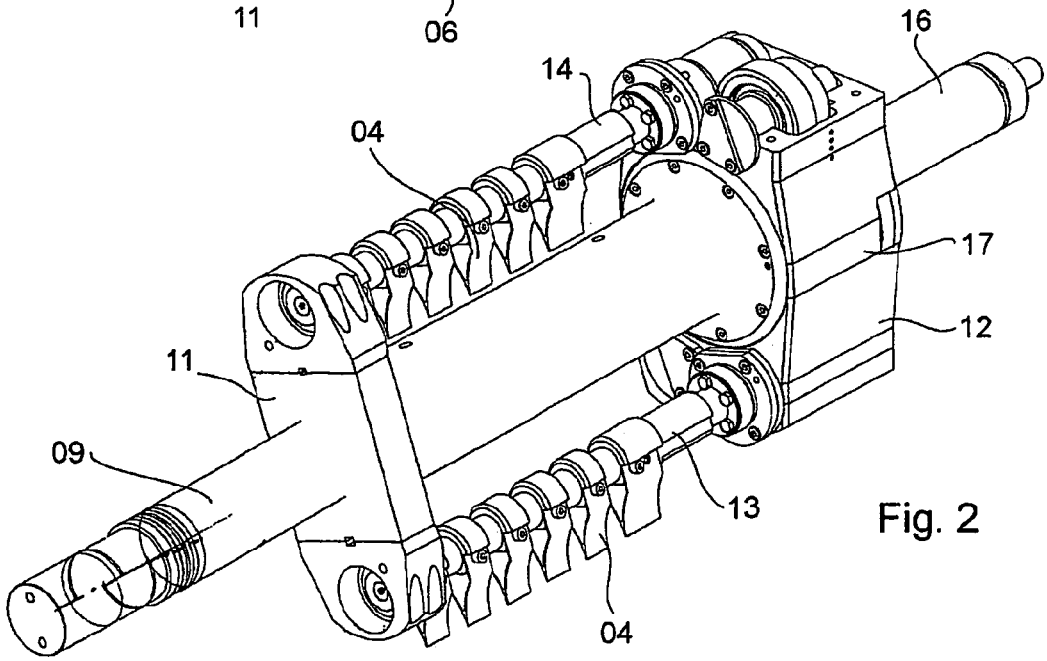
Fig. 2

FOLDING APPLIANCES

CROSS-REFERENCE TO RELATED APPLICATIONS

This patent application is the U.S. National Phase, under 35 U.S.C. 371, of PCT/DE 03/00269, filed Jan. 31, 2003; published as WO 03/072477A1 on Sep. 4, 2003, and claiming priority to DE 102 08 292.8 filed Feb. 26, 2002, the disclosures of which are expressly incorporated herein by reference.

FIELD OF THE INVENTION

The present invention is directed to folding apparatus The folding apparatus has a rotational folding blade cylinder for conveying a signature to be folded and at least one folding blade.

BACKGROUND OF THE INVENTION

DD 41 520 describes a wheel folding apparatus, whose folding blade movement can be switched between two modes of operation by the use of two different planetary wheels. A change of the fold in the product is not provided.

DE 197 55 428 A1 shows a device for changing the folding mechanisms of a folding cylinder of a folding apparatus.

DE 12 22 082 B discloses a folding apparatus with a rotatable folding blade cylinder for conveying a signature to be folded. The folding blade cylinder has a folding blade which is rotatable around a first shaft, which itself is maintained on a support, which support is rotatable around a second shaft. The folding blade can be extended out of the folding blade cylinder in the course of its revolution. The rotation of the folding blade is coupled with a variable phase to the rotation of the folding blade cylinder. The folding blade cylinder is rotatably coupled to a cutting cylinder by a transmission gear.

SUMMARY OF THE INVENTION

It is the object of the present invention to provide folding apparatus.

In accordance with the present invention, the object is attained by the provision of a folding apparatus having a rotatable folding blade cylinder for conveying a signature to be folded. At least one folding blade, which is rotatable around a first shaft, is carried inside the folding blade cylinder. The folding blade shaft is held on a support that is rotatable around a second shaft. The folding blade, in the course of its rotation, can be extended out of the folding blade cylinder.

The advantages which can be obtained by the present invention lie, in particular, in that a differential gear, which is employed for setting the relative phases of the support in relation to the conveying cylinder, performs the phase setting exclusively by rotary movements and not by translatory movements. The structural size of a differential gear, in contrast to that of a linear actuating member, is independent of the phase variation which can be realized by it. Differential gears, which can be employed within the framework of the present invention, are standard parts which are produced industrially in great numbers and which are available at a reasonable cost. Preferred types of such differential gears are harmonic drive gears or planetary gears.

Of the three drive or power take-off members of such a differential gear, one is preferably connected to a servo motor that is configured with a brake. This servo motor is only operating as long as the phase is being changed. When the folding apparatus operates normally, the motor is deactivated and the brake is set.

The folding blade cylinder of the folding apparatus, in accordance with the present invention, preferably has a plurality of holders, such as grippers or rows of spur needles, which plurality of holders are usable for holding a product to be conveyed by the folding blade cylinder.

To accomplish the cutting the products to be folded from a continuous product strand, the folding blade cylinder preferably works together with a cutting blade cylinder. In this case, the number "m" of cutting blades in the cutting cylinder can be less than the number "n" of the holders on the folding blade cylinder, if both cylinders are rotatorily coupled by the use of a suitable transmission with a transmission ratio of "n"/"m" in such a way that both of the cylinders have the same circumferential speeds.

To facilitate the moving the folding blades within the folding blade cylinder without hindrance, the number of the following blades is preferably also less than the number "n" of the holders on the folding blade cylinder. If the number "n" of holders is selected to equal the number "m" of the cutting blades on the cutting cylinder, the support can be coupled, in a simple manner, to the cutting cylinder by the use of the differential gear with a transmission ratio of 1:1.

BRIEF DESCRIPTION OF THE DRAWINGS

Preferred embodiments of the present invention are represented in the drawings and will be described in greater detail in what follows.

Shown are in:

FIG. 1, a somewhat schematic perspective plan view of a folding blade cylinder in accordance with the present invention, in FIG. 2, a view, in the same perspective as in FIG. 1, of the internal structure of the folding blade cylinder, in FIG. 3, a schematic section through a folding apparatus with the folding blade cylinder of FIG. 1, in FIG. 4, a schematic section through a first embodiment of the folding apparatus, with a harmonic drive gear, which harmonic drive gear couples the rotation of the folding blade support within the folding blade cylinder with the rotation of the folding blade cylinder, in FIG. 5, a schematic section, generally similar to FIG. 4, and through a second preferred embodiment of the folding apparatus, which has a planetary gear as the differential gear, in FIG. 6A to C, schematic depictions showing the effects of a change of the differential gear on the finished folded product, and in FIG. 7, further embodiments in schematic section through a folding apparatus in accordance with the present invention.

DESCRIPTION OF THE PREFERRED EMBODIMENTS

Figure 3:
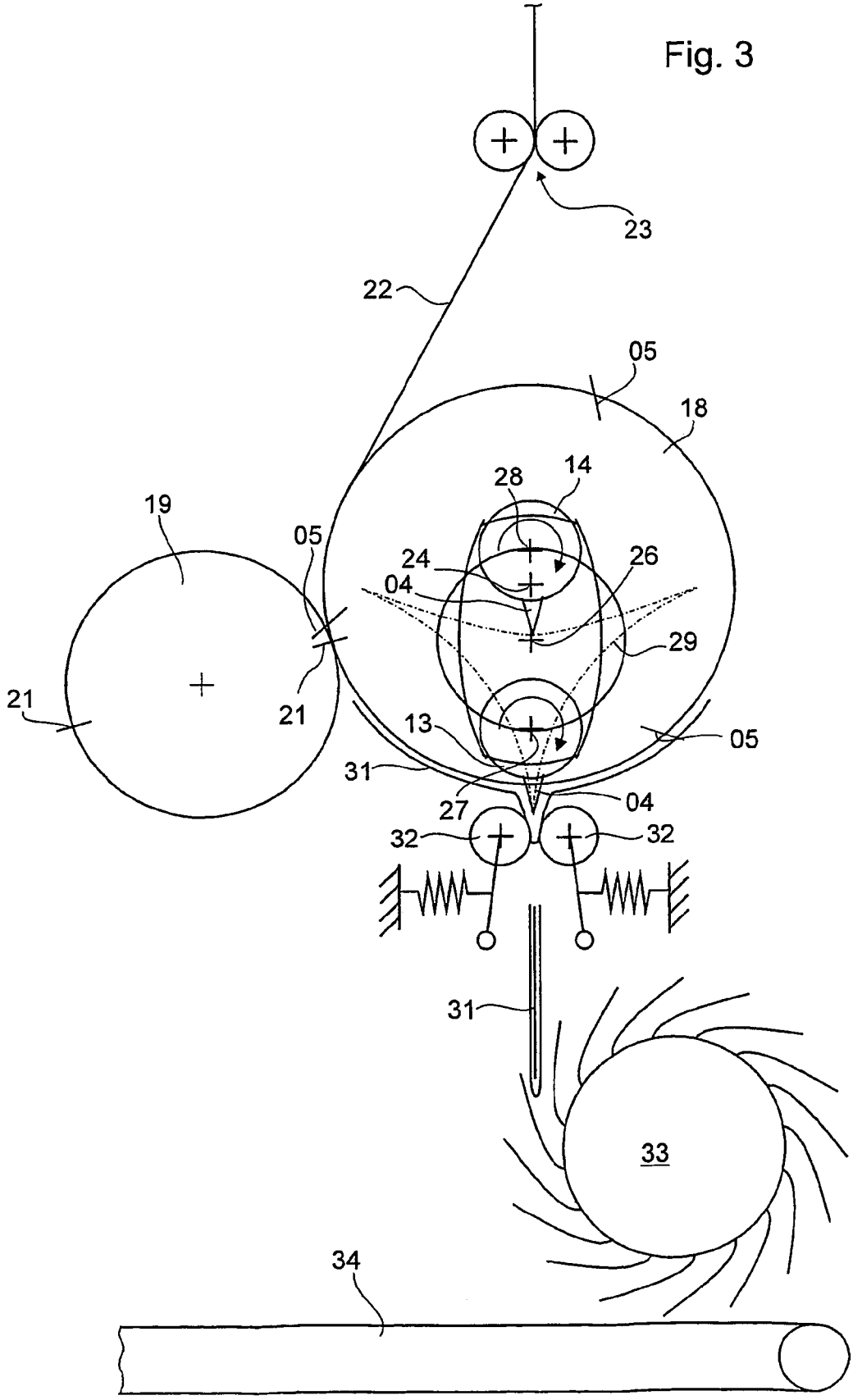

Referring initially to FIG. 1, there may be seen a preferred embodiment of a folding apparatus folding blade cylinder in accordance with the present invention. Three groups of slits 02, each spaced at an angular distance of 120° in a circumferential direction from each other, have been formed in a drum shell 01 of a folding blade cylinder 18, as represented in FIG. 1. A plurality of protruding projections 03 are shown positioned in the group of slits 02 located at the top of the drum shell 01 shown in FIG. 1, which projections 03 are the tips of a folding blade 04. The folding blade 04 is fastened on a support 20 in the interior of the folding blade cylinder 18, which support 20 will be explained in greater detail with reference to FIG. 2.

Figure 4:
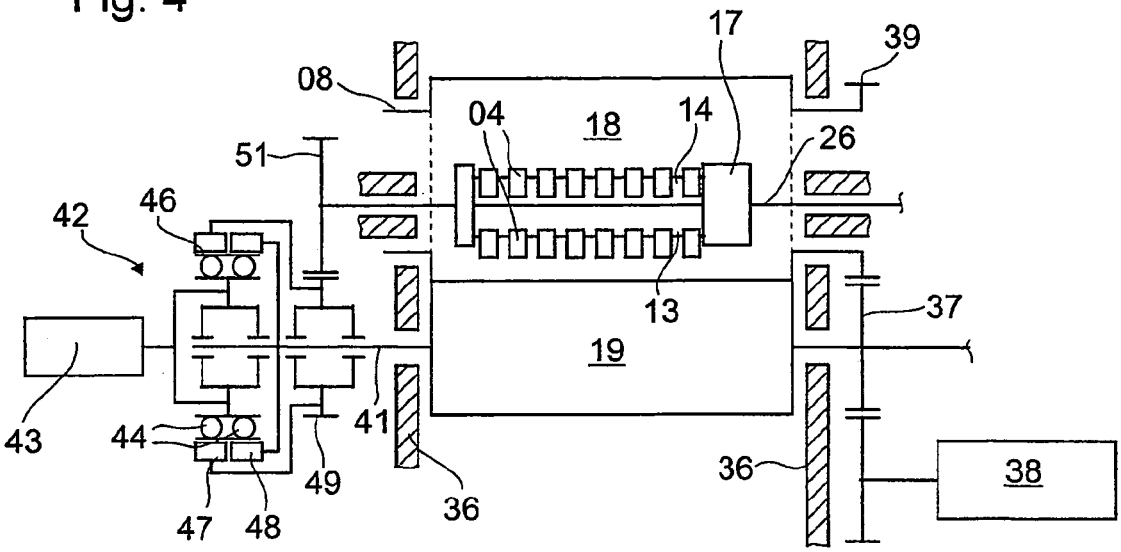
Figure 5:
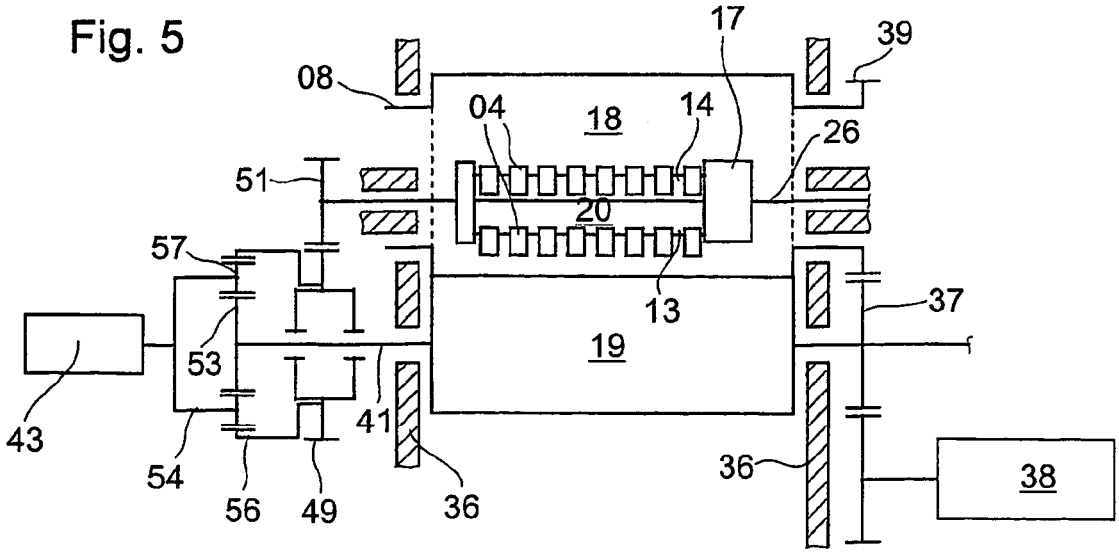

The drum shell of the folding blade cylinder 18 also has three strips with extendable spur needles 05. These strips can also be replaced by grippers or by other devices for holding a product to be folded on the drum shell 01. Two end flanges 06, each provided with an enlarged central opening 07, which central opening 07 is concentric with respect to a longitudinal axis of the drum shell 01, are located at the front or end faces of the drum shell 01. A shaft 08 has been connected to the opening 07, as is seen in FIGS. 4 and 5, and this shaft 08 is used for the rotatable seating, or support, of the folding blade cylinder 18 in a frame, which is not specifically represented of a folder.

A shaft 09, which is supporting the support 20 of folding blades 04 arranged inside the folding blade cylinder 18, extends eccentrically through the opening 07, as is shown in FIG. 1.

FIG. 2, shows the structure of this support 20 which, in use, is situated inside drum shell 01. In the interior of the folding blade cylinder 18, the shaft 09 carries two arms 11, which project radially in opposite directions, and a gear unit 12, which arms 11 and gear unit 12 support two folding blade shafts 13, 14, which two folding blade shafts 13, 14 are rotatable around axes which are parallel to the shaft 09. The housing 17 of the gear unit 12 is rigidly connected with the section of the shaft 09 facing the viewer, as depicted in FIG. 2. The gear unit housing 17 is rotatable in the interior of the folding blade cylinder together with this section of shaft 09. On the far side of the gear unit 12; i.e. to the right of gear unit 12 in the perspective in FIG. 2, the shaft 09 is extended by a shaft segment 16, which shaft segment 16 is rotatable with respect to the housing 17 of the gear unit 12. When the gear unit 12 is rotated around the axis of the shaft 09, a gear wheel that is not specifically represented, and which is rigidly connected with the shaft segment 16 in the interior of the gear unit 12, causes a rotation of the folding blade shafts 13, 14.

The schematic side elevation view of FIG. 3 illustrates the overall structure of a folding apparatus having the folding blade cylinder 18 described with reference to FIGS. 1 and 2 FIG. 3 also illustrates the movement of the folding blades 04 inside the folding blade cylinder 18 during the operation of the folding apparatus in accordance with the present invention.

First, the overall structure of the folding apparatus will be briefly explained. The folding blade cylinder 18 is rotatably supported in lateral frames 36, as depicted schematically in FIGS. 4 and 5, in contact with a cutting cylinder 19. The cutting cylinder 19 has two diametrically oppositely spaced cutting blades 21 which, working together with the folding blade cylinder 18, cut a web 22 of material, for example a paper web 22, into individual products or signatures 31. This paper web 22 is fed to a gap that is formed between the folding blade cylinder 18 and the cutting cylinder 19 from a folding apparatus, which is not represented via a pair of traction and guide rollers 23. The ratio of the number of revolutions of the cutting cylinder 19 to that of the folding blade cylinder 18 is 3:2, and their relative phase has been set in such a way that a cutting blade 21 severs the paper web 22 closely in front of a strip of spur needles 05 of the folding blade cylinder 18, which have previously engaged the then uncut paper web 22. The leading end of the paper web 22 that is formed in this way, after it is spiked by the spur needles 05, is conveyed on in FIG. 3 along the surface of the folding blade cylinder 18 in a counterclockwise direction in the course of rotation of the folding blade cylinder 18.

Three revolutions of the support 20, or three rotations of the folding blade shafts 13, 14 around the support shaft 26, which includes shaft 09 and shaft segment 16, occur for every two revolutions of the folding blade cylinder 18 around its shaft 24, which includes the shaft 08. In the course of each rotation of the folding blade shafts 13, 14, the folding blades 04 mounted thereon perform two revolutions around the axes 27 or 28 of the folding blade shafts 13, 14. Therefore, the tips of the folding blades 04 move on a path 29 that is represented by a dash-dotted line in FIG. 3, and which has the approximate shape of a triangle with concave sides. The lower tip of this triangular path 29 is located outside of the circumference of the folding blade cylinder 18, as seen in FIG. 3. At this location, the folding blades 04 extend out of the folding blade cylinder 18 in order to introduce a signature 31, which was cut off the paper web 22, into a gap between two folding rollers 32. A bucket wheel 33 is located underneath the gap, into whose buckets the folded signatures 31 fall, so that they may be subsequently deposited on a conveyor belt 34.

FIG. 4 shows a first preferred embodiment of the drive structure of the folding apparatus shown generally in FIG. 3. The folding blade cylinder 18 and the cutting cylinder 19 are rotatably supported between lateral frame plates 36 of the folding apparatus. A shaft 41 of the cutting cylinder 19 has a gear wheel 37 on one side, which may be, for example, a driving gear wheel 37, and which meshes, on one side, with a gear of a main motor 38, and on the other side with a gear wheel 39, for example a driving gear wheel 39 of the folding blade cylinder 18. A harmonic drive gear, or HD gear, is mounted at the opposite end of the shaft 41 of the cutting cylinder 19. A rotor 42 with an elliptical cross section, which is rotatable around the shaft 41, can be driven by a servo motor 43. A flexible ring 46, which is deformed corresponding to the shape of the ball bearings 44 and has an exterior tooth arrangement, has been drawn onto the rotor 42 and is separated by a bearing 44, for example a ball bearing 44, which is deformed corresponding to the shape of the rotor 42. This ring 46, which is also frequently referred to as a flex spline 46, meshes with two sleeves 47, 48, which are arranged axially side-by-side and which both have teeth on their interior surfaces. Here, the flex spine or ring 46 is in engagement with the inside teeth of the sleeves 47, 48 at two oppositely located respective locations on the long axis of the ellipse, and the number of teeth on flex spin 46 is less, by a small even number, than the number of teeth of the sleeves 47, 48.

As a characteristic feature, a harmonic drive gear, or HD gear, has at least one flexible deformable ring with a tooth arrangement.

One of the sleeves 48 is connected, fixed against relative rotation, with the cutting cylinder shaft 41, while the other sleeve 47 is fixedly connected with a sleeve gear wheel 49, which can be rotated around, and with respect to the shaft 41, and which meshes with a gear wheel 51, for example a driving gear wheel 51 of the support 20.

The number of teeth of the gear wheels 37, 39 have been selected in such a way that they accomplish a number of revolution ratio of 3:2 between the cutting cylinder 19 and the folding blade cylinder 18. The number of teeth of the sleeves 47, 48, and of the gear wheels 49, 51 are equal to each other, so that, as long as the servo motor 43 is stopped, the cutting cylinder 19 and the support 20 rotate at the same number of revolutions. To assure that the relative phase of the cutting cylinder 19 and the support 20 can be kept constant during the operation of the folding apparatus, the servo motor 43 is equipped with a brake, which is capable of preventing any rotation of the rotor 42.

Figure 6A:
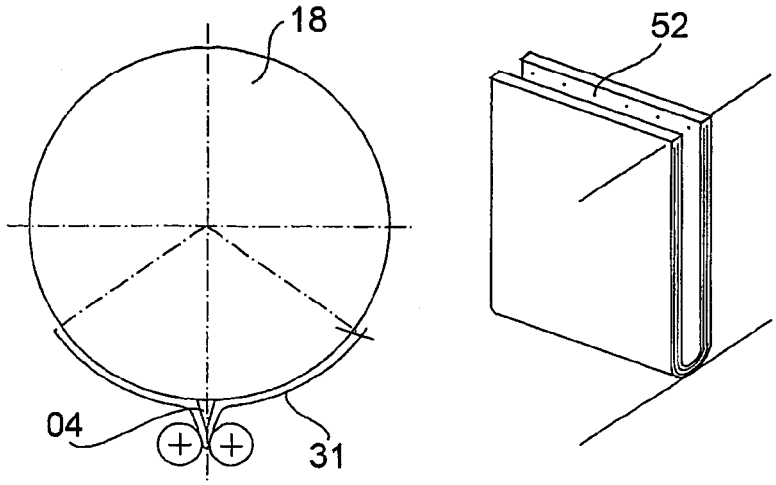

The phase of the movement of the folding blade 04 on its path 29, in relation to the phase of the rotation of the folding blade cylinder 18, can be changed by turning the rotor 42. This means that the position of the exit point or location in the elogated slits 02 where the folding blades 04 extend out of the drum shell 01 can be adjusted with respect to the spur needles 05. In a normal operating position, as shown in FIG. 6A, the exit point of the folding blades 04 is located exactly centered between the two ends of the signature 31 conveyed on the folding blade cylinder 18. The finished, folded signature 31, shown at the right in FIG. 6A, has legs of the same length on both sides of the fold line.

Figure 6B:
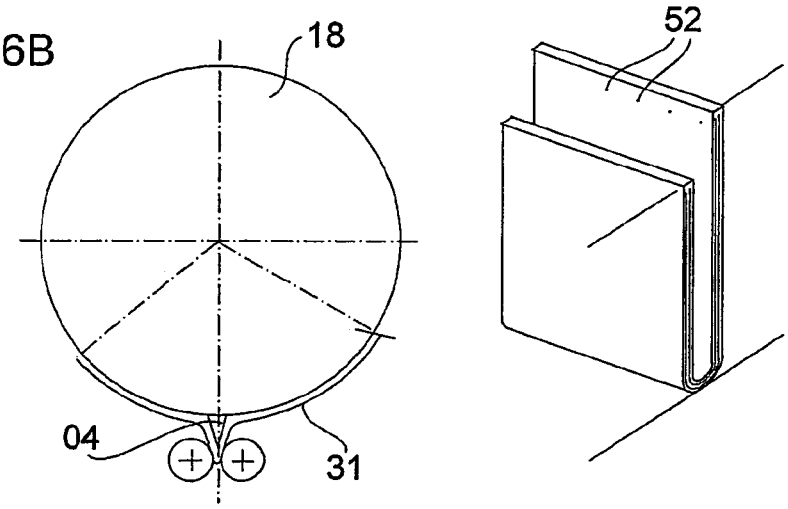

If the phase of the folding blade movement is retarded, with respect to that of the folding blade cylinder 18, as shown in FIG. 6B, an asymmetrically folded signature 31 is formed, wherein the leading leg of the signature held by the spur needles 05, which leading leg can be recognized by the puncture holes 52, is longer than the leg which is trailing in the conveying direction.

Figure 6C:
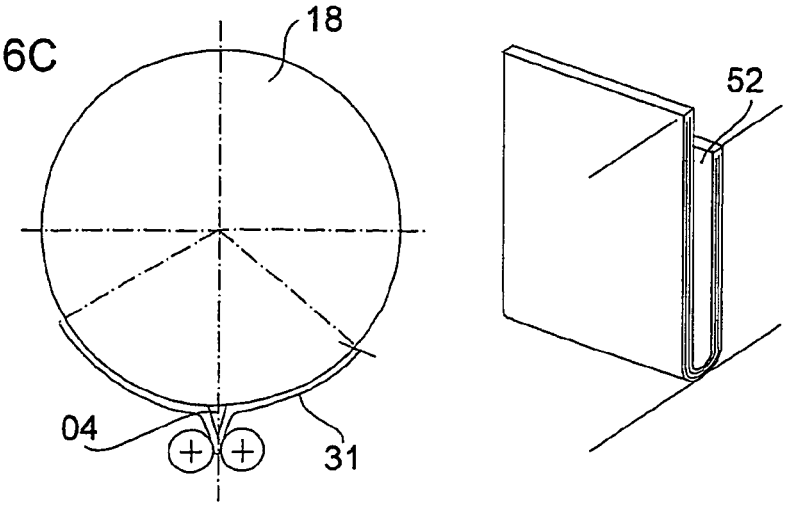

By advancing the phase of the folding blade movement, as shown in FIG. 6C, an opposite asymmetry is achieved.

FIG. 5 shows a second preferred embodiment of the drive structure of the folding apparatus. Elements which are identified in FIG. 5 by the same reference symbols, as were used in FIG. 4, are identical with the elements described in respect to FIG. 4, and these elements will not be described again. On its end facing away from the main motor 38, the shaft 41 of the cutting cylinder 19 has a sun gear wheel 53 of a planetary gear assembly. A planetary support 54, with planetary gear wheels 57 meshing with the sun gear wheel 53, is mounted on the driveshaft of the servo motor 43. A ring gear 56 of the planetary gear assembly is connected, fixed against relative rotation, with the gear wheel 49, which gear wheel 49 meshes with the driving gear wheel 51 of the support 20.

Since the number of teeth of the sun gear wheel 53 is less than that of the ring gear 56, with the brake of the servo motor 43 engaged, the ring gear 56 rotates more slowly than the sun gear wheel 53. The number of teeth of the gear wheels 49, 51 have been selected in such a way that a number of revolution ratio of 1:1 between the shaft 41 and the support 20 results for the entire differential gear.

Figure 7:
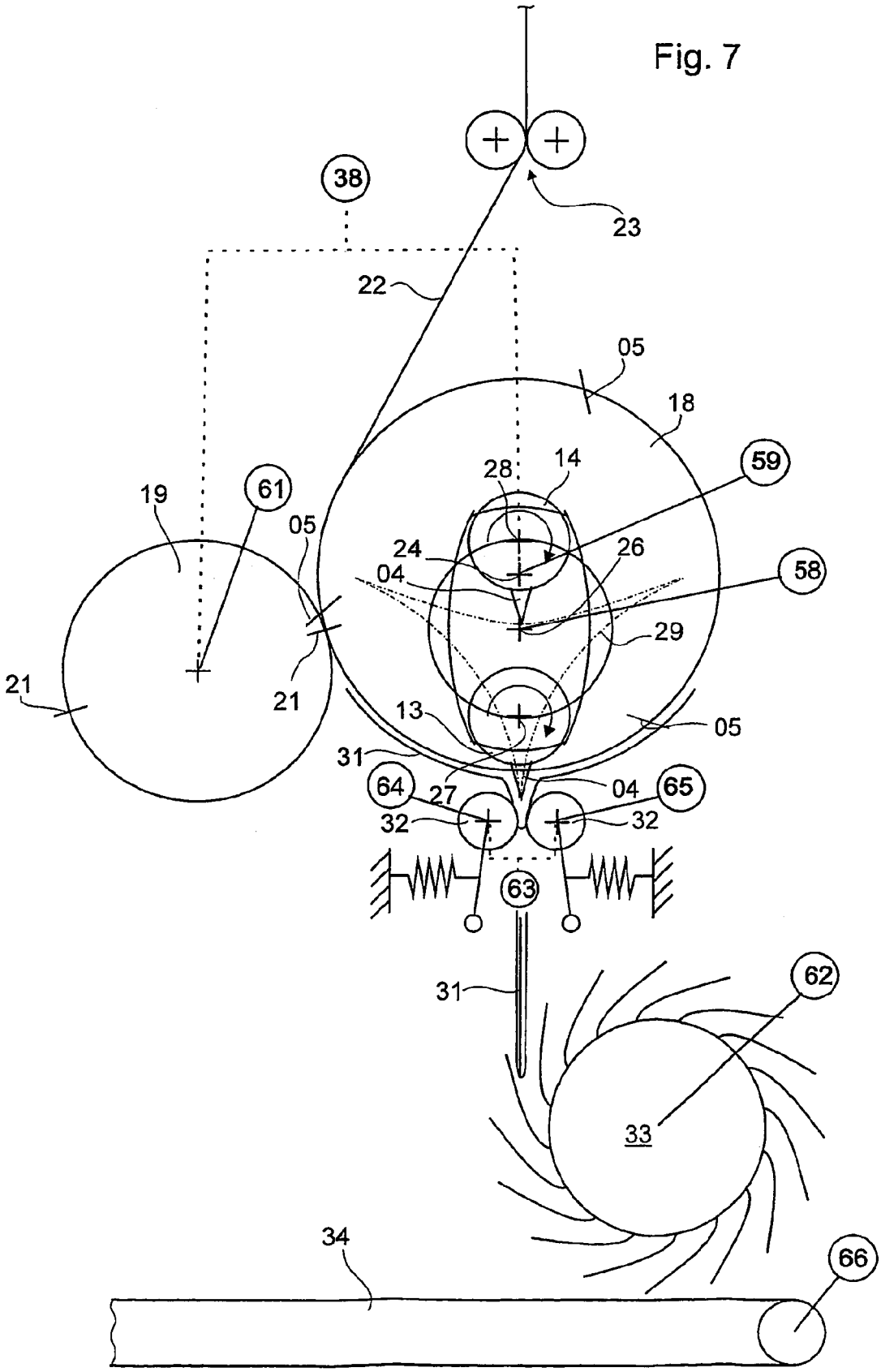

FIG. 7 shows advantageous embodiments of the present invention in connection with the drive mechanism of the folding apparatus.

As represented in FIG. 7, the folding apparatus is driven by at least one electric motor 59, 61 of its own, which is mechanically independent of other units. The shaft 26 of the support 20 is driven by a further electric motor 58 during the folding process. This further electric motor 58 of the support 20 is not mechanically connected with the drive mechanism of the folding blade cylinder 18.

Thus, in one embodiment of the present invention, the folding blade cylinder 18 is driven by the electric motor 59, which is not coupled with a further cylinder. In another embodiment of the invention, the cutting cylinder 19 is driven by the electric motor 61, which is also not coupled with a further cylinder. As represented by dashed lines in FIG. 7, it is also possible to drive the folding blade cylinder 18, as well as the cutting cylinder 19, by a common electric motor 38.

A bucket wheel 33 is arranged in the folding apparatus, whose drive mechanism is mechanically connected with the drive mechanism of the folding blade cylinder 18. During the folding operation, the bucket wheel 33 is driven by its own electric motor 62, which is not mechanically coupled with a cylinder of the folding apparatus.

Furthermore, two folding rollers 32, which cooperate to form a folding gap, are assigned to the folding apparatus. The folding rollers 32 are driven by a common electric motor 63, as represented by dashed lines, which motor 63 is not coupled with a cylinder. In another embodiment, the folding rollers 32 can also each be driven by their own electric motor 64, 65.

A conveyor belt system 34 is furthermore connected to the folding apparatus. This conveyor belt system 34 can also be driven by its own electric motor 66.

The angular positions of the electric motors 38, 59, 61, 62, 63, 64, 65, 66 of the folding apparatus are controlled.

A regulating device for regulating the phase position of the electric motors 38, 59, 61, 62, 63, 64, 65, 66 with respect to each other is provided in the folding apparatus.

Thus, the phase position of the electric motor 58 of the support 20 and the phase position of the electric motor 59 of the folding blade cylinder 18 can be changed with respect to each other. In the same way, the phase position and/or the number of revolutions of the electric motor 58 of the support 20 and/or of the electric motor 59 of the folding blade cylinder 18, and the electric motor 63, or 64, 65 of the folding rollers 32 can be changed relative to each other. By use of the regulating device for regulating the phase positions, it is also possible to change the phase position of the electric motor 62 of the bucket wheel 33 and at least one other of the electric motors 38, 58, 59, 61, 63, 64, 65, 66 relative to each other. The phase position and/or the number of revolutions of the electric motor 62 of the bucket wheel 33 and of the electric motor 66 of the conveyor belt system 34 can also be changed relative to each other.

When making reference to the folding blade cylinder 18, this is understood to be primarily a reference to the drum shell 01 of the folding blade cylinder 18.

While preferred embodiments of folding appliances, in accordance with the present invention, have been set forth fully and completely hereinabove, it will be apparent to one of skill in the art that a number of changes in, for example the type of web being folded, the type of printing press used to print the web, and the like could be made without departing from the true spirt and scope of the present invention which is accordingly to be limited only by the following claims.

What is claimed is:

1. A folding apparatus comprising:

a rotatable folding blade cylinder adapted to convey a signature to be folded;

a support in said folding blade cylinder;

a rotatable support shaft connected to said support and supporting said support for rotation in said rotatable folding blade cylinder;

a support drive gear connected to said support shaft;

at least a first folding blade shaft supported on, and spaced from said support for rotation with respect to said support;

a folding blade carried by said folding blade shaft, said folding blade being extendable out of said folding blade cylinder in response to rotation of said support and said folding blade shaft;

a cutting blade cylinder cooperating with, and driving said folding blade cylinder;

means for phase-shifting said support and said folding blade cylinder relative to each other wherein said rotation of said folding blade cylinder and of said support are coupled, with a variable phase, to a rotation of said cutting blade cylinder;

a differential gear assembly coupling said support drive gear and said cutting cylinder; and a differential gear drive connected to said differential gear assembly.

2. The folding apparatus of claim 1 wherein said differential gear assembly is one of a harmonic drive gear and a planetary gear.

3. The folding apparatus of claim 1 further including a servo motor, said differential gear assembly being connected to said servo motor.

4. The folding apparatus of claim 3 further including a brake for said servo motor.

5. The folding apparatus of claim 1 further including a brake adapted to act on said differential gear assembly.

6. The folding apparatus of claim 1 further wherein said differential gear assembly is connected to each support by a power take-off member.

7. The folding apparatus of claim 1 further including a plurality of signature holders on said folding blade cylinder.

8. The folding apparatus of claim 7 wherein said holders are selectively one of grippers and rows of spur needles.

9. The folding apparatus of claim 7 further including a transmission gear in said differential gear assembly and having a transmission ratio of n/m wherein n is a number of said signature holders on said folding blade cylinder and m is a number of cutting blades on said cutting blade cylinder and further wherein said number of cutting blades is not greater than said number of signature holders.

10. The folding apparatus of claim 9 further wherein said number of said signature holders is the same as a number of said folding blades on said support and wherein said differential gear assembly has a ratio of 1:1.

11. The folding apparatus of claim 10 further including a main drive motor acting on said transmission gear for driving said folding blade cylinder and said cutting cylinder.

12. The folding apparatus of claim 9 further including a main drive motor acting on said transmission gear for driving said folding blade cylinder and said cutting cylinder.

13. The folding apparatus of claim 1 further including a folding gap and wherein said at least one folding blade is adapted to conduct a signature into said folding gap.

14. The folding apparatus of claim 13 further including a pair of oppositely rotating folding rollers forming said folding gap.

15. The folding apparatus of claim 1 further including a common electric drive motor for said folding blade cylinder and said cutting cylinder.

16. The folding apparatus of claim 1 further including a folding blade cylinder electric drive motor.

17. The folding apparatus of claim 1 further including a cutting cylinder electric drive motor.

18. The folding apparatus of claim 1 further including a bucket wheel.

19. The folding apparatus of claim 18 further including a bucket wheel drive mechanism and a folding blade cylinder drive mechanism, said bucket wheel drive mechanism being mechanically connected with said folding blade cylinder drive mechanism.

20. The folding apparatus of claim 18 further including a bucket wheel drive motor.

21. The folding apparatus of claim 20 wherein a phase position of said bucket wheel electric motor, and of at least one other of an electric motor can be changed relative to each other and further including a regulating device adapted to regulate said phase portions.

22. The folding apparatus of claim 1 further including first and second folding rollers defining a folding gap.

23. The folding apparatus of claim 22 further including an electric drive motor for said folding rollers.

24. The folding apparatus of claim 23 wherein a phase position of a support electric motor, of said folding blade cylinder, and of said folding rollers can be changed relative to each other and further including a regulating device adapted to regulate said phase positions.

25. The folding apparatus of claim 1 further including a conveyor belt system.

26. The folding apparatus of claim 25 further including a conveyor belt system electric drive motor.

* * * * *